US005534307A

United States Patent [19]

Hikita et al.

[11] Patent Number: 5,534,307

[45] Date of Patent: Jul. 9, 1996

[54] RESIN IMPREGNATING METHOD FOR FIBROUS SUBSTRATE

[75] Inventors: Hiroshi Hikita; Tetsuo Kohriyama; Yutaka Nozawa; Yoshito Sugino, all of Kawasaki, Japan

[73] Assignee: Fuji Electric Co., Ltd., Kanagawa, Japan

[21] Appl. No.: 321,891

[22] Filed: Oct. 14, 1994

[30] Foreign Application Priority Data

Oct. 15, 1993 [JP] Japan ..... 5-257363

[51] Int. Cl.[6] ..... B05D 7/00

[52] U.S. Cl. ..... 427/421; 427/425; 427/424

[58] Field of Search ..... 427/421, 425, 427/424; 192/107.6

[56] References Cited

U.S. PATENT DOCUMENTS

| | | | |
|---|---|---|---|
| 4,297,307 | 10/1981 | Taylor | 264/29.5 |
| 4,592,939 | 6/1986 | Temple et al. | 427/162 |
| 4,928,625 | 5/1990 | Woods | 427/256 |
| 5,217,778 | 6/1993 | LaCasse | 428/64 |

FOREIGN PATENT DOCUMENTS

| | | |
|---|---|---|
| 2663565 | 12/1991 | France . |
| 2239986 | 2/1974 | Germany . |
| 3044977 | 9/1981 | Germany . |
| 3802548 | 8/1989 | Germany . |
| 4023541 | 1/1992 | Germany . |
| 4023176 | 1/1992 | Germany . |
| 4135579 | 4/1992 | Germany . |
| 4034291 | 4/1992 | Germany . |
| 4208884 | 10/1992 | Germany . |
| 4202194 | 7/1993 | Germany . |
| 62-266174 | 11/1987 | Japan . |
| 5-253523 | 10/1993 | Japan . |
| 1464179 | 2/1977 | United Kingdom . |
| 2098886 | 12/1982 | United Kingdom . |
| 2177324 | 1/1987 | United Kingdom . |
| 90/06185 | 6/1990 | WIPO . |

*Primary Examiner*—Shrive Beck
*Assistant Examiner*—David M. Maiorana
*Attorney, Agent, or Firm*—Spencer & Frank

[57] ABSTRACT

A method of impregnating with resin a frictional plate for power transmission built into a brake pad or clutch facing. The frictional plate or work comprises a metallic base plate joined to a fiber based substrate containing friction increasing material. The resin impregnating method comprises moving a work in a predetermined direction while ejecting resin from at least one nozzle, spaced at a predetermined distance from the work, and moving in a direction transverse to the direction of movement of the work. The resin impregnated into the fiber based substrate of the work is dried by utilizing the air flow generated by the movement of the work.

7 Claims, 3 Drawing Sheets

RESIN IMPREGNATING METHOD FOR FIBROUS SUBSTRATE

BACKGROUND OF THE INVENTION

1. Field of the Invention

The present invention relates to a method of impregnating resin in a frictional plate such as a brake pad, a clutch facing usable for transmitting the driving torque generated by an engine to driving wheels for a vehicle.

2. Description of the Related Art

A frictional plate usable for the purpose of power transmission is built in a friction brake or clutch for a vehicle in order to transmit the power generated by an engine to driving wheels by utilizing the frictional resistance appearing when the surface of each frictional plate is thrusted against a rotational plate facing thereto. In view of the foregoing fact, it has been required that the frictional plate exhibits a large magnitude of frictional resistance, sufficiently proofs against the heat generated by friction, and hardly wears. The frictional plate which can satisfactorily meet the foregoing requirement is typically exemplified by a frictional plate which is constructed such that a paper-shaped fiber based substrate including inorganic filler as friction increasing material therein is joined to a metallic base plate, it is impregnated with a predetermined quantity of thermosetting resin having excellent heat resistance as a bonding agent, and subsequently, it is heated and cured, whereby not only a mechanical strength but also thermal conductivity of the frictional plate are substantially increased.

The hitherto known conventional resin impregnating method applicable to the power transmitting frictional plate constructed in the above-described manner is practiced such that a frictional plate impregnated with no resin is dipped in a resin bath, it is subjected to resin impregnating treatment for a predetermined time in a normal pressure atmosphere or a reduced pressure atmosphere, subsequently, an extra quantity of resin is drained or removed from the frictional plate for a long time in the environmental atmosphere or it is forcibly wiped off from the frictional plate by thrusting a roller against the latter, and thereafter, the resin impregnated in the frictional plate is cured at a room temperature or it is subjected to curing treatment by blowing hot air to the frictional plate.

When this conventional resin impregnating method is employed, a number of frictional plates can be handled at the same time but there is liable to arise a malfunction that the frictional plate is irregularly impregnated with the resin, the resin quickly flows out of the frictional plate during resin draining treatment or drop-like resin spots appear on the frictional plate. For this reason, with the conventional resin impregnating method, there often arises a difficulty that a predetermined quantity of resin is uniformly impregnated in the fiber based substrate. This leads to the problem that properties of the thus obtained frictional plate are liable to fluctuate. In addition, with the conventional resin impregnating method, since the resin adheres to the whole surface of the frictional plate, many manhours are required for masking a plurality of threaded holes formed in or through a metallic base plate with a certain sheet-like material, and moreover, wiping an extra quantity of resin from the fiber based substrate with an operator's hand. Consequently, the conventional resin impregnating method has drawbacks that each frictional plate is treated or worked for a long time at an increased cost, and an increased quantity of resin is consumed during the impregnating treatment.

In addition, with the conventional resin impregnating method, since a number of frictional plates are subjected to impregnating treatment at the same time, a large quantity of resin is required for achieving impregnating treatment for producing the frictional plates. Additionally, since it is required that a measure is taken for protecting a building and associated facilities from possible explosion caused attributable to inflammable volatile solvent contained in a large quantity of resin, an installation cost required for practicing the conventional impregnating method is undesirably increased. When the resin accumulatively received in a resin bath is contaminated with foreign material adhering to the frictional plate, it is required that the contaminated resin is cleaned by removing the foreign material therefrom. Further, since a concentration and viscosity of each of non-volatile components of the resin are increased due to chemical transformation of the resin caused by the evaporation of the solvent from the resin and the absorption of environmental moisture in the latter, it is practically difficult to keep the viscosity of the resin in the resin bath constant, resulting in a high controlling cost being required for practicing the resin impregnating method. Once the resin in the resin bath is contaminated with foreign material, there arises a problem that the viscosity of the resin varies, causing a quality of product, i.e., frictional plate to be adversely affected by the varied viscosity.

Moreover, with the conventional resin impregnating method, when a number of frictional plates are subjected to impregnating treatment at the same time, a large volume of solvent vapor is generated from the frictional plates not only during the resin draining step but also during the resin drying step, resulting in the concentration of organic solvent in the working environment being increased. To cope with the foregoing malfunction, it is necessary that a large-sized ventilating unit is installed in operative association with a resin impregnating apparatus in order to prevent the concentration of organic solvent in the working environment from being increased. At this time, however, there arises another problems that noisy sound is generated due to the large-sized ventilating unit installed in that way, and moreover, the working environment is contaminated with the resin which falls down from the frictional plates. In the circumstances as mentioned above, many requests have been raised from users for satisfactorily solving various problems as mentioned above.

SUMMARY OF THE INVENTION

An object of the present invention is to provide a resin impregnating method which assures that a fiber based substrate constituting part of a frictional plate can uniformly be impregnated with suitable quantity of resin, and moreover, the resin impregnated in the fiber based substrate can be dried in a short time.

Other object of the present invention is to provide a resin impregnating apparatus which can reliably practice a resin impregnating method of the foregoing type.

Another object of the present invention is to provide a resin impregnating method which assures that a good working environment can satisfactorily be maintained compared with a conventional resin impregnating method, and moreover, each frictional plate can automatically be impregnated with resin.

Further object of the present invention is to provide a resin impregnating apparatus which can reliably practice a resin impregnating method of the foregoing type.

According to one aspect of the present invention, there is provided a resin impregnating method which comprises a step of moving a work in a predetermined direction, the work including a metallic base plate and a fiber based substrate joined to the metallic base plate, the fiber based substrate including friction increasing material therein, a step of traversing at least one nozzle in the direction orienting at a cross angle relative to the direction of movement of the work, the nozzle being spaced away from the work with a predetermined gap and serving to eject resin therefrom so as to allow the fiber based substrate to be impregnated with the ejected resin, and a step of promotively drying the resin impregnated in the fiber based substrate by utilizing the air flow generated as the work is moved.

In the case that the work is prepared in the for m of a circular plate, it is desirable that the work is caused to rotate about the center axis thereof. In this case, it is desirable that the nozzle is traversed in the radial direction of the work, causing the resin to be ejected along a spiral locus on the fiber based substrate.

In addition, in the case that the work is moved with reciprocating motion or conveyed, it is desirable that the nozzle is traversed with reciprocating motion, causing the resin to be ejected along a zigzag locus on the fiber based substrate.

Further, according to other aspect of the present invention, there is provided a resin impregnating apparatus which comprises work driving means for moving a work in a predetermined direction, the work including a metallic base plate and a fiber based substrate joined to the metallic base plate, the fiber based substrate including friction increasing material therein, at least one nozzle spaced away from the work with a predetermined gap, nozzle driving means for traversing the nozzle in the direction orienting at a cross angle relative to the direction of movement of the work achieved with the aid of the work driving means, resin feeding means communicated with the nozzle and a tank storing resin so as to allow the fiber based substrate to be impregnated with the resin, the resin feeding means serving to eject the resin from the nozzle at a predetermined rate, and controlling means for controlling a speed of movement of the work achieved with the aid of the work driving means, a speed of traverse of the nozzle achieved with the aid of the nozzle driving means, and a rate of ejection of the resin from the nozzle achieved with the aid of the resin feeding means.

In the case that the resin impregnating apparatus is equipped with a plurality of nozzles, it is desirable that the nozzles serve to feed resin to different positions on the fiber based substrate with the aid of the resin feeding means. In addition, it is acceptable that the nozzle driving means further includes means for adjusting the gap between the nozzles and the work.

It is also acceptable that the work driving means includes a rotary table which serves to clamp and to rotationally drive the work. In this case, it is desirable that the nozzle driving means serves to traverse the nozzle in the radial direction of the rotary table.

In the case that the work driving means includes a shuttle table which serves to clamp and to straight-lined reciprocate the work or it includes a palette which serves to clamp and to convey the work, it is desirable that nozzle driving means serves to reciprocate.

According to the present invention, the work is moved in the predetermined direction with the aid of the work driving means, and moreover, at least one nozzle disposed relative to the work with a predetermined gap for ejecting resin therefrom so as to allow the fiber based substrate to be impregnated with the resin is traversed by the nozzle driving means in the direction orienting at a cross angle relative to the direction of movement of the work. Thus, the resin ejected to the fiber based substrate is distributed on the surface of the fiber based substrate within the range determined depending on the kinetic inertia force exerted on the work and the wetability of the fiber based substrate with the resin, and subsequently, it penetrates into the fiber based substrate by virtue of the penetrability of the resin derived from the capillary phenomenon.

Thus, the fiber based substrate can uniformly be impregnated with suitable quantity of resin neither too much nor too less by properly controlling a speed of movement of the work and a speed of traverse of the nozzle with the aid of the controlling means, and moreover, controlling a rate of ejection of the resin from the nozzle achieved by the resin feeding means and properly adjusting the viscosity of the resin. In addition, since the resin does not adhere to any part of the work unacceptable for allowing the resin to adhere thereto, there does not arise a malfunction that the working environment is contaminated with the adhering resin. Additionally, a cleaning operation can simply be achieved for removing the adhering resin from the surface of the fiber based substrate, and a resin impregnating operation can automatically performed with the apparatus. Moreover, a quality of work can be stabilized and improved, and a running life of the resin tank can be elongated without any deterioration of properties of the resin accumulatively received in the resin tank. Since vapor of the solvent contained in the resin can completely be discharged outside of the apparatus during impregnating treatment, it is possible to simplify the structure of a ventilating unit employed for the apparatus.

In addition, since the resin ejected from the nozzle and impregnated in the fiber based substrate is promotively dried by the air flow generated as the work is moved in the above-described manner, it can be dried in a short time to such an extent that it does not adhere to the surface of the fiber based substrate. Thus, it is possible to convey each work by operating an automatic conveyor line while preventing undesirable contamination of the working environment with the resin and other foreign material.

In addition, in the case that the apparatus is equipped with a plurality of nozzles for ejecting resin to different locations on the surface of the fiber based substrate, it becomes possible to simultaneously perform resin impregnating operations using the plurality of nozzles, resulting in an operational efficiency of the apparatus being substantially improved. Incidentally, in the case that the nozzle driving means is additionally equipped with means for adequately adjusting the gap between the nozzles and the work, it becomes possible to adjust the kinetic inertia force exerted on the resin ejected from the nozzles, causing the distribution of the ejected resin over the surface of the fiber based substrate to be properly controlled. Thus, the resin can more uniformly be fed to the fiber based substrate compared with a conventional apparatus.

Other objects, features and advantages of the present invention will become apparent from reading of the following description which has been made in conjunction with the accompanying drawings.

BRIEF DESCRIPTION OF THE DRAWINGS

The present invention is illustrated in the following drawings in which.

DESCRIPTION OF THE PREFERRED EMBODIMENTS

The present invention will now be described in detail hereinafter with reference to the accompanying drawings which illustrate preferred embodiments thereof.

Figure 1:
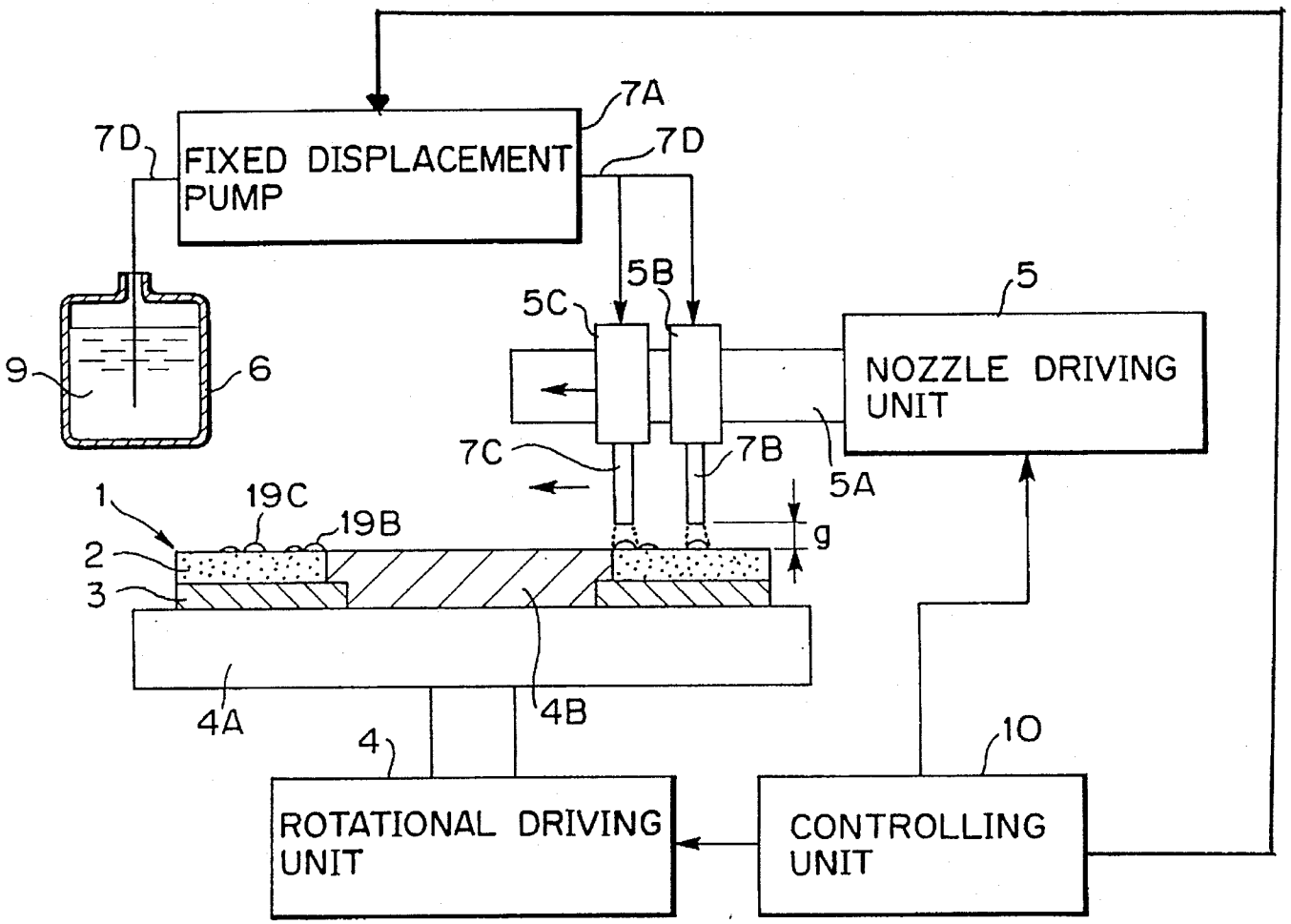
FIG. 1 is a schematic side view of a resin impregnating apparatus constructed in accordance with an embodiment of the present invention wherein the resin impregnating apparatus is applied to a clutch facing for a vehicle.
Figure 2:
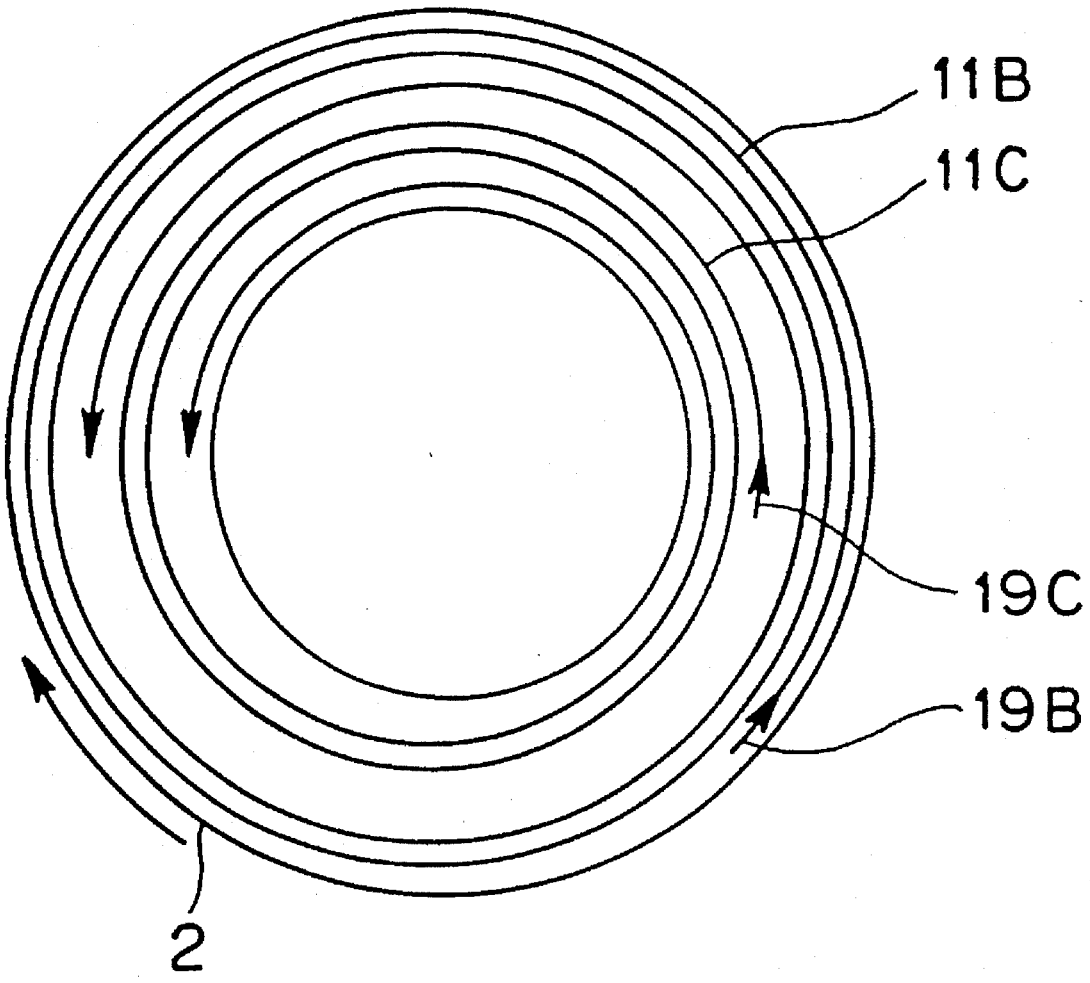
FIG. 2 is a fragmentary plan view of the resin impregnating apparatus shown in FIG. 1, particularly showing how nozzles are relatively traversed along spiral loci on a work.

FIG. 1 and FIG. 2 show a resin impregnating apparatus constructed in accordance with an embodiment of the present invention. In FIG. 1, reference numeral 1 designates a clutch facing that is a work forming a circular disc-shaped contour to be treated. The clutch facing 1 is composed of an annular fiber based substrate 2 including inorganic filler as friction increasing material and an annular metallic base plate 3, and the fiber based substrate 2 and the metallic base plate 3 are joined to each other using an adhesive. To assure that the metallic base plate 3 comes in contact with a rotary table 4A of a rotational driving unit 4, the metallic base plate 3 is immovably placed on the rotary table 4A with the aid of a guide plate **4*b* fitted into a circular hole of the metallic base plate 3, e.g., by threadably tightening a bolt (not shown) while the center axis of the metallic base plate 3 is correctly aligned with the center axis of the rotary table 4A**.

In addition, the apparatus includes a guide rail 5A which extends above the rotary table 4A in the radial direction of the latter, and a pair of nozzle holders 5B and 5C are traversably disposed on the guide rail 5A in the spaced relationship in such a manner as to be slidably traversed along the guide rail 5A. Both the nozzle holders 5B and 5C are simultaneously driven with reciprocating motion in the same direction by activating a nozzle driving unit 5 while maintaining a predetermined gap therebetween. The nozzle holders 5B and 5C are equipped with nozzles 7B and 7C which are downwardly projected toward the rotary table 4A side in such a manner as to enable the positions assumed by the nozzles 7B and 7C to be adequately adjusted in the upward/downward direction relative to the rotary table 4A. With this construction, a gap g between the lowermost ends of the nozzles 7A and 7C and the surface of the fiber based substrate 2 constituting the clutch facing 1 placed on the rotary table 4A can be adjusted as desired. The nozzles 7B and 7C are communicated with a resin tank 6 storing resin 9 accumulatively received therein via a feeding line 7D so that the fiber based substrate 2 is impregnated with the resin 9. As is apparent from FIG. 1, a fixed displacement pump 7A is disposed along the feeding line 7D. As the pump 7A is driven, the resin 9 in the tank 6 is fed to the fiber based substrate 2 via the nozzles 7B and 7C at a predetermined rate.

In addition, reference numeral 10 designates a controlling unit. The controlling unit 10 serves to output signals therefrom to the rotational driving unit 4, the nozzle driving unit 5 and the pump 7 in order to control a speed of rotation of the rotary table 4A rotated by the rotational driving unit 4, a speed of slidable traverse of the nozzle holders 5B and 5C and a rate of ejecting of the resin 9 from the nozzles 7B and 7C fed from the pump 7A while establishing correct operative association among both the speeds and the ejecting rate.

Next, a mode of operation of the apparatus constructed in the aforementioned manner will be described below.

When the nozzles 5B and 5C are traversed in the leftward direction as seen in FIG. 1 while the rotary table 4A is rotated at a constant speed, e.g., in the clockwise direction, the nozzles 7B and 7C are relatively rotated along spiral loci 11B and 11C shown in FIG. 2 while maintaining the gap g between the lowermost ends thereof and the fiber based substrate 2. As the resin 9 in the tank 6 is ejected from the nozzles 7B and 7C with the aid of the pump 7A, two streams of ejected resin designated by reference numerals 19B and 19C are spirally distributed along the spiral loci 11B and 11C on the fiber based substrate 2. When the two streams 19B and 19C of ejected resin come in contact with the rotating fiber based substrate 2, a certain intensity of centrifugal force generated by the rotation of the rotary table 4A is applied to the two streams 19B and 19C of resin. Subsequently, the two streams 19B and 19C of resin are radially distributed by the thus applied centrifugal force within the range defined by the viscosity of the resin 9 and the wetability of the fiber based substrate 2, and thereafter, the fiber based substrate 2 is increasingly impregnated with the resin 9 by virtue of the penetrability of the resin into the fiber based substrate 2 appearing attributable to a capillary phenomenon.

With such construction, a quantity of feeding of the resin 9 per unit area on the fiber based substrate 2 is determined depending on a plurality of parameters, i.e., the viscosity of the resin 9, the rate of ejecting of the resin 9 from the nozzles 7B and 7C, the wetability of the fiber based substrate 2 with the resin 9, the penetrability of the resin 9 into the fiber based substrate 2, the speed of rotating of the fiber based substrate 2, and the speed of slidable traverse of the nozzle holders 5B and 5C while the foregoing parameters interfere with each other. In this connection, optimum conditions associated with the quantity of feeding the resin 9 per unit area on the fiber based substrate 2 can be determined based on the results derived from experiments. Once the optimum conditions are determined in that way, the fiber based substrate 2 can uniformly be impregnated with a proper quantity of resin 9 under the foregoing optimum conditions without any particular loss of the resin 9. In addition, since there does not arise a malfunction that an extra quantity of resin adheres to the surface of the fiber based substrate 2, the surrounding environment is not contaminated with the extra quantity of resin, and moreover, no cleaning operation is required for removing the extra quantity of resin from the fiber based substrate 2. Consequently, a resin impregnating operation can automatically be performed with the apparatus.

As the fiber based substrate 2 is rotated, an air flow is generated on the surface of the fiber based substrate 2. Thus, it is possible to promote the vaporization of a solvent contained in the streams 19B and 19C of resin penetrated into the fiber based substrate 2 by utilizing the foregoing air flow. For example, in the case that a quantity of ejecting of the streams 19B and 19C of resin toward the fiber based substrate 2 is set to several ten milligrams per one $cm^2$ and the speed of rotation of the rotary table 4A is set to several ten revolutions per minute to several hundred revolutions per minute, the surface of the fiber based substrate 2 can be dried for a short period of time of several seconds to such an extent that the resin does not adhere thereto any more. Owing to the foregoing fact, the concentration of an organic solvent as measured in the working environment can be reduced to a predetermined value or less merely by arranging a local ventilating unit. In addition, the clutch facing 1 held in the dried state can easily and quickly be conveyed to a next step, e.g., a hot air drying step by driving an automatic conveying line.

In addition, according to this embodiment, plural locations on the fiber based substrate 2 can simultaneously be impregnated with the resin 9 by disposing a plurality of nozzles on the rail 5A in the spaced relationship as seen in the radial direction, resulting in an operational efficiency of the apparatus being substantially improved. Additionally, since the gap g between the lowermost ends of the nozzles 5B and 5C and the surface of the fiber based substrate 2 can adequately be adjusted, the streams 19B and 19C of resin can more uniformly be fed to the fiber based substrate 2 by adjusting an intensity of centrifugal force applied to the streams 19B and 19C of resin ejected toward the surface of the fiber based substrate 2 so as to adequately control the distribution of the streams 19B and 19C of resin as seen in the radial direction.

In such manner, as the nozzles 5B and 5C are traversed above the fiber based substrate 2 while maintaining a predetermined gap therebetween, the streams 19B and 19C of resin can correctly be ejected along the spiral loci 11B and 11C on the fiber based substrate 2 under the conditions that the direction of rotation of the fiber based substrate 2 and the direction of traverse of the nozzles 5B and 5C are preliminarily determined, and moreover, the viscosity of the resin 9 and the rate of ejecting of the resin 9 are preliminarily adjusted. Consequently, the whole surface of the fiber based substrate 2 can uniformly be impregnated with suitable quantity of resin 9 neither too much nor too less.

The embodiment shown in FIG. 1 and FIG. 2 has been described above with respect to a circular disc-shaped work, i.e., a clutch facing 1 for a vehicle. However, the present invention should not be limited only to this embodiment. Alternatively, the present invention can equally be applied to a rectangular plate-shaped work.

Figure 3:
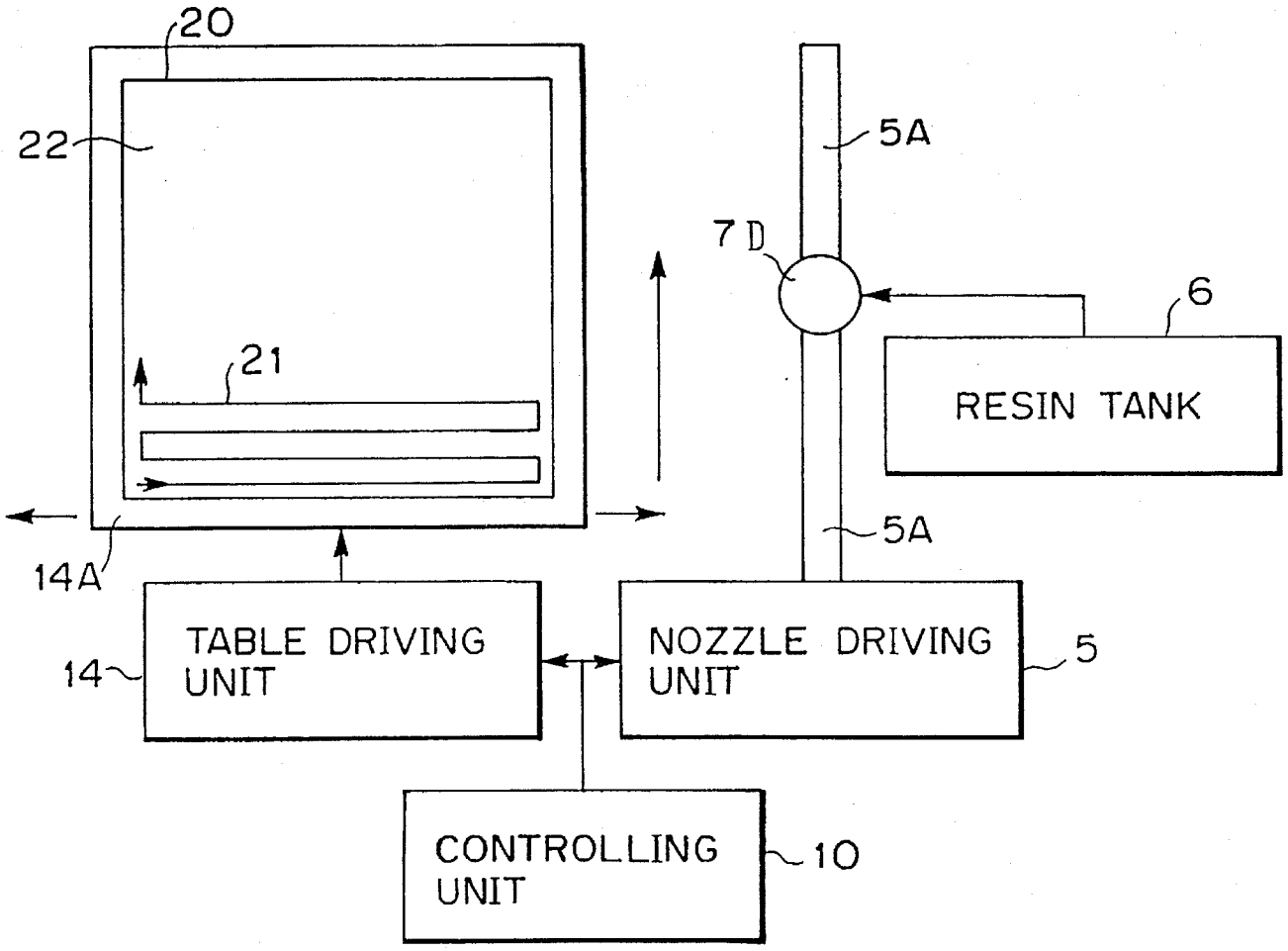
FIG. 3 is an illustrative view which schematically shows the structure of a resin impregnating apparatus constructed in accordance with another embodiment of the present invention.

Next, a resin impregnating apparatus conducted in accordance with another embodiment of the present invention will be described below with reference to FIG. 3. FIG. 3 is an illustrative plan view which schematically shows the structure of the apparatus. Specifically, a rectangular plate-shaped work 20 having a fiber based substrate 22 joined to the upper surface thereof is immovably held on a shuttle table 14A at a predetermined position of the latter with the aid of fixing means (not shown), and the shuttle table 14A can linearly be moved in the leftward/rightward direction as seen in FIG. 3 by activating a table driving unit 14. A guide rail 5A extending in the upward/downward direction as seen in FIG. 3 at a right angle relative to the direction of movement of the shuttle table 14A is arranged above the shuttle table 14A. A nozzle holder 7B is operatively engaged with the guide rail 5A in such a manner as to slidably traverse along the guide rail 5A, and a speed of traverse of the nozzle holder 7B can adequately be controlled by activating a nozzle driving unit 5. In addition, a nozzle (not shown) is fitted to the nozzle holder 7B, and the lowermost end of the nozzle is spaced away from the upper surface of the fiber based substrate 22 with a predetermined gap. The position of the nozzle held on the nozzle holder 7B can be dislocated from the nozzle holder 7*b* to ward or away from the fiber based substrate 22 as desired. With such construction, the gap between the lowermost end of the nozzle and the upper surface of the fiber based substrate 22 can adequately be adjusted. The nozzle is communicated with a resin tank 6 via a fixed displacement pump (not shown), and a predetermined volume of resin is accumulatively received in the resin tank 6. As the pump is driven, the resin in the resin tank 6 is ejected from the lowermost end of the nozzle at a predetermined rate.

As the nozzle is intermittently traversed in the upward/downward direction as seen in FIG. 3 in operative association with the reciprocating motion of the shuttle table 14A in the leftward/rightward direction as seen in the drawing, the resin is fed along a zigzag locus 21 on the fiber based substrate 22. Thus, the fiber based substrate 22 can uniformly be impregnated with a proper quantity of resin by utilizing the kinetic inertia force exerted on the ejected resin and the permeability of the resin into the fiber based substrate 22. In addition, as the fiber based substrate 22 is moved with reciprocating motion in that way, an air flow is generated on the fiber based substrate 22, causing the solvent contained in the resin to be promotively evaporated from the fiber based substrate 22 by the thus generated air flow. This leads to the result that the surface of the fiber based substrate 22 impregnated with the resin can be dried to such an extent that the resin loses adhesiveness to the fiber based substrate 22 in a short time.

The embodiment shown in FIG. 3 has been described above with respect to the case that a single nozzle is fitted to the nozzle holder 7B. However, the present invention should not be limited only to this case. Alternatively, a plurality of nozzles may be fitted to the nozzle holder 7B in the spaced relationship in order to substantially improve an operational efficiency of the apparatus.

In addition, a plurality of pallets arranged on a pallet conveyor adapted to be intermittently moved may be substituted for the shuttle table 14A shown in FIG. 3. In this case, a work is placed on each of the pallets, and resin is ejected from at least one nozzle adapted to be traversed with reciprocating motion in the transverse direction relative to the conveying direction of the pallet conveyor to each work on the pallet conveyor while exhibiting a zigzag pattern, whereby a number of works can continuously be impregnated with the thus ejected resin. In addition, in this case, it is recommendable that works each impregnated with no resin are placed on a pallet located at the inlet end part of the pallet conveyor, and works impregnated with resin and then held in the dried state are taken out of the pallet conveyor at the outlet end part of the latter.

While the present invention has been described above only with respect to two preferred embodiments thereof, it should of course be understood that the present invention should not be limited only to these embodiments but various change or modification may be made without any departure from the scope of the present invention as defined by the appended claims.

What is claimed is:

1. A resin impregnating method comprising the steps of:

moving a work in a predetermined direction, said work including a metallic base plate and a fiber based substrate joined to said metallic base plate, said fiber based substrate including friction increasing material therein;

moving at least one nozzle in a direction transverse to the direction of movement of said work, said nozzle being spaced from said work with a predetermined gap and serving to eject resin therefrom so as to allow said fiber based substrate to be impregnated with the ejected resin; and drying said resin impregnated in said fiber based substrate by utilizing the air flow generated as said work is moved.

2. A resin impregnating method as claimed in claim 1, wherein said work is in the form of a circular plate, the movement of said work in the predetermined direction being a rotational motion about a center axis of said work.

3. A resin impregnating method as claimed in claim 2, wherein said nozzle is moved in the radial direction of said work, said movement causing the resin to be ejected along a spiral locus on said fiber based substrate.

4. A resin impregnating method as claimed in claim 1, wherein the movement of said work in the predetermined direction is achieved by a reciprocating straight-line motion.

5. A resin impregnating method as claimed in claim 4, wherein said nozzle is moved with a reciprocating motion, said movement causing the resin to be ejected along a zigzag locus on said fiber based substrate.

6. A resin impregnating method as claimed in claim 1, wherein the movement of said work in the predetermined direction is achieved by a conveying operation.

7. A resin impregnating method as claimed in claim 6, wherein said nozzle is moved with a reciprocating motion, said movement causing the resin to be ejected along a zigzag locus on said fiber based substrate.

* * * * *